United States Patent [19]

Meulendyk

[11] 4,435,133

[45] Mar. 6, 1984

[54] FREE PISTON ENGINE PUMP WITH ENERGY RATE SMOOTHING

[75] Inventor: John W. Meulendyk, Kalamazoo, Mich.

[73] Assignee: Pneumo Corporation, Boston, Mass.

[21] Appl. No.: 842,494

[22] Filed: Oct. 17, 1977

[51] Int. Cl.[3] ..... F04B 17/00

[52] U.S. Cl. ..... 417/364; 417/487

[58] Field of Search ..... 417/380, 486, 487, 488, 417/265, 268, 214, 364, 340; 123/139 AJ

[56] References Cited

U.S. PATENT DOCUMENTS

| | | | |
|---|---|---|---|
| 1,271,712 | 7/1918 | Humphrey | 417/268 X |
| 1,294,271 | 2/1919 | Humphrey et al. | 417/364 X |
| 3,606,591 | 9/1971 | Potma | 417/364 |
| 3,775,027 | 11/1973 | Craft | 417/487 X |
| 3,995,974 | 12/1976 | Herron | 417/380 X |

*Primary Examiner*—Leonard E. Smith

*Attorney, Agent, or Firm*—Maky, Renner, Otto & Boisselle

[57] ABSTRACT

A free piston engine pump which utilizes plural hydraulic piston areas or hydraulic pressures, with suitable valving to properly "phase" these areas or pressures during the engine stroke, to generate plural hydraulic work rates in order to smooth out the energy or work rate of the free piston engine and minimize the inertia-storage of energy required.

32 Claims, 18 Drawing Figures

FREE PISTON ENGINE PUMP WITH ENERGY RATE SMOOTHING

BACKGROUND OF THE INVENTION

This invention relates generally as indicated to a free piston engine pump, which is effective in smoothing out the energy or work rate of a free piston engine to facilitate pumping of hydraulic fluid.

A free piston engine pump differs from the usual piston engine driven pump in that the reciprocating movement of the piston is not first transmitted to a crankshaft to convert linear movement to rotary movement and then back to linear movement by means of a pump swashplate to drive the pump piston. Instead, a direct linear drive connection is provided between the engine piston and pump piston for effecting linear movement thereof. Eliminating the linear-to-rotary crankshaft elements and rotary-to-linear pump swashplate results in a substantial reduction in size and weight of the pump and also greatly improves the efficiency thereof.

Heretofore, a principal drawback in driving a free piston engine pump with an internal combustion engine is that the energy output of an internal combustion piston is very uneven over its stroke and may vary, for example, by as much as 30 to 1 during the power cycle. The maximum pressure of the Diesel cycle, for example, might typically be 1,000 psi, and the minimum pressure 30 psi, with an average pressure or MEP during the power stroke of 150 psi. The Otto cycle is similar.

A conventional engine uses a flywheel to smooth out the energy output, which in theory could also be utilized in the same way with a free piston engine. However, using a heavy mass integral or attached to the engine/pump piston to store energy during the first, accelerating portion of the power stroke, when the hydraulic work rate is much less than the engine cycle work rate, and removing such energy from the mass during the latter portion of the power stroke when the piston is decelerating is an undesirable solution for even moderate engine power because the piston mass required is much greater than that required by normal design. Also, very high velocities are required, implying large hydraulic losses, etc. Similar but less severe implications and problems would also apply to a hydraulic-powered return stroke of a free-piston engine pump, as well as to a motor-pump where gas-expansion occurs in the power cycle.

SUMMARY OF THE INVENTION

With the foregoing in mind, it is a principal object of this invention to provide a free piston engine pump which effectively smoothes out the energy or work rate of a free piston engine pump for pumping hydraulic fluid without the necessity of using a flywheel or other heavy mass.

Another object is to minimize the inertia-storage of energy required during the power stroke of a free piston engine pump.

Still another object is to reduce the inertia mass and/or peak velocities of a free piston engine pump for a given power output.

Yet another object is to reduce the engine/pump size and weight for a given power output.

A further object is to reduce cycle time without incurring the efficiency losses which normally accompany higher piston speeds.

Another object is to reduce hydraulic losses from a free piston engine pump.

A still further object is to reduce the engine/pump mass balancing problems of a free piston engine pump.

Yet another object is to provide non-uniform return stroke energy to a free piston pump to achieve optimum return stroke timing and accelerated return movement of the pump.

These and other objects of the present invention may be achieved by providing a free piston engine pump with plural hydraulic piston areas or hydraulic pressures, and suitable valving to properly "phase" these areas or pressures during the engine stroke, to minimize the inertia-storage of energy required. Both the plural-area and plural-pressure techniques provide plural levels of hydraulic output work (energy) to better match the natural variation of energy (work) rate of the internal combustion cycle. A high work rate phase may also be generated at the end of the power stroke to cause rapid deceleration at the end of the stroke and thus effect a higher ratio of average piston speed to peak speed, which tends to reduce cycle time without incurring the efficiency losses which accompany higher piston speeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but one of the various ways in which the principles of the invention may be employed.

and

Figure 13:
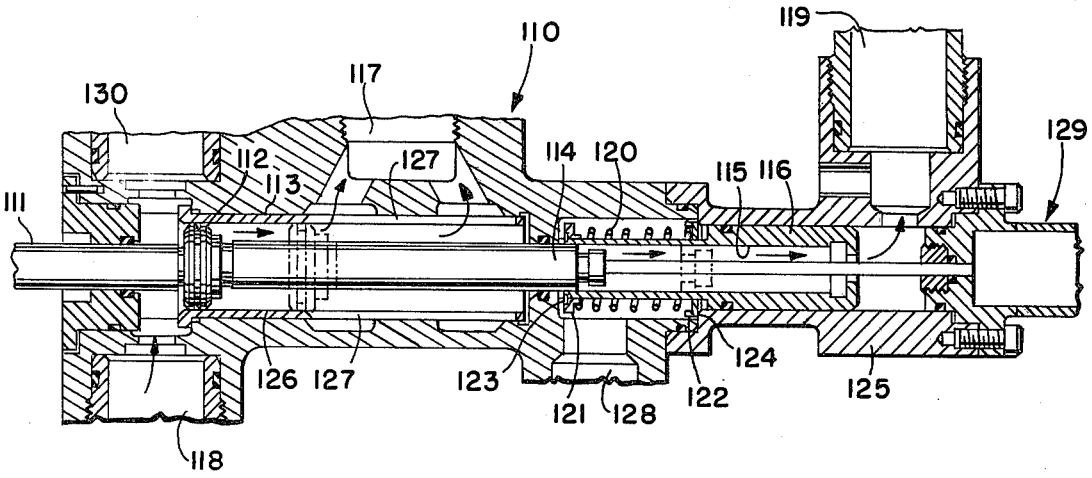
Figure 14:
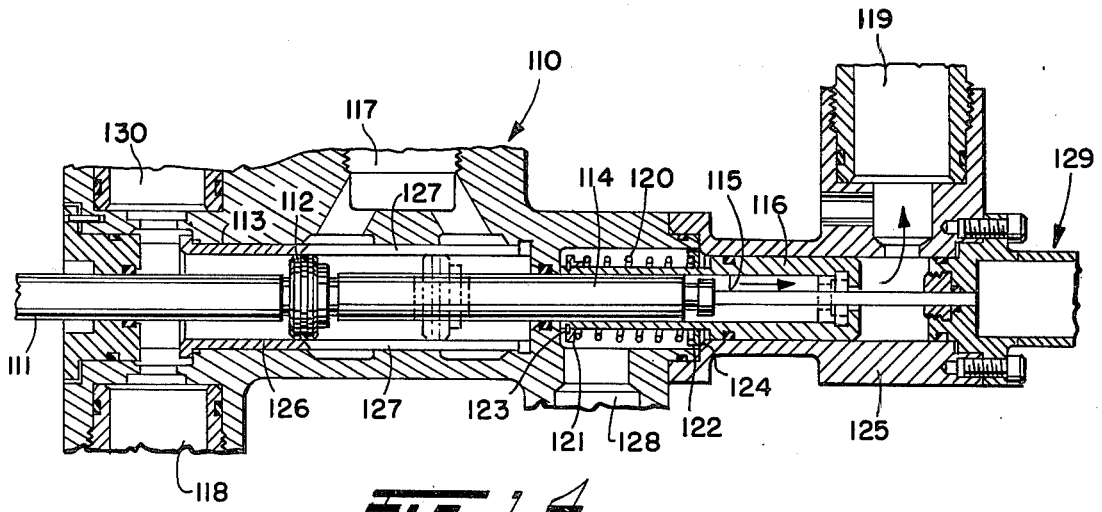
Figure 15:
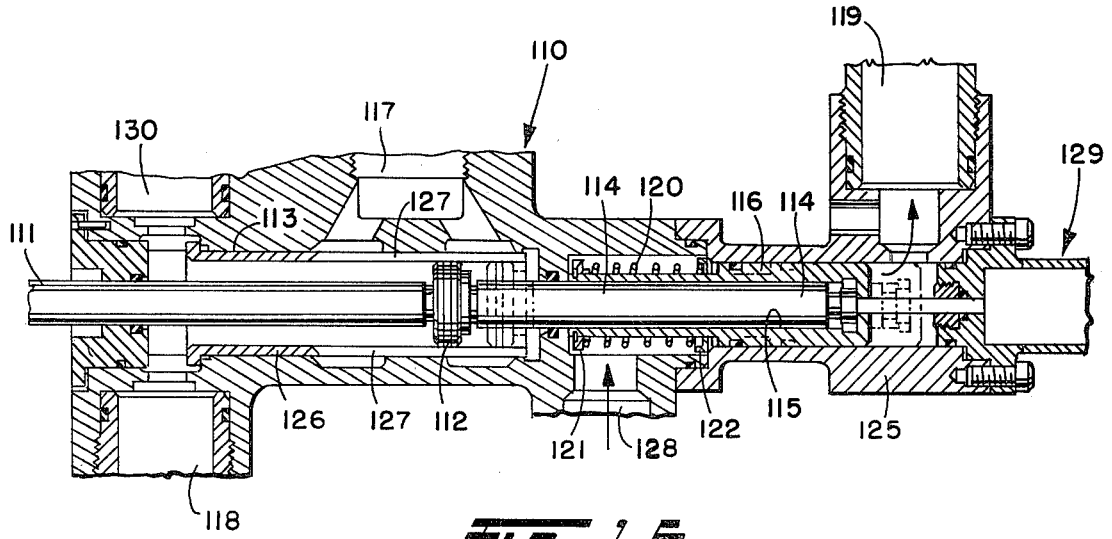
Figure 16:
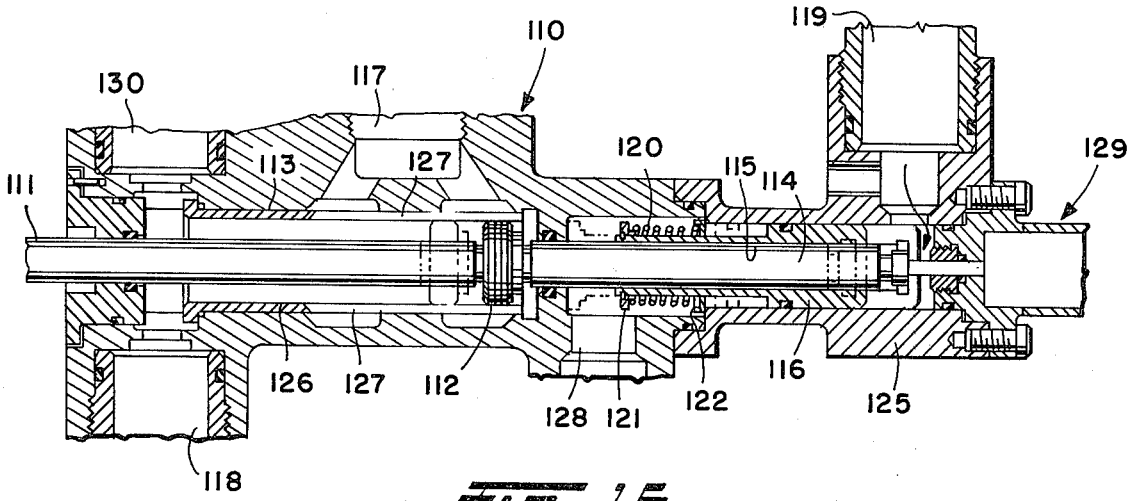
Figure 17:
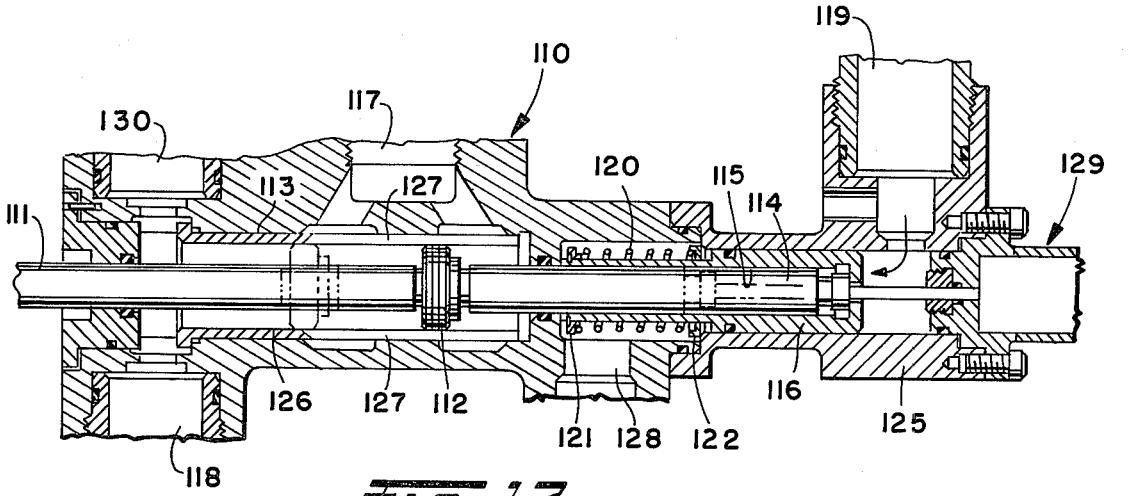
Figure 18:
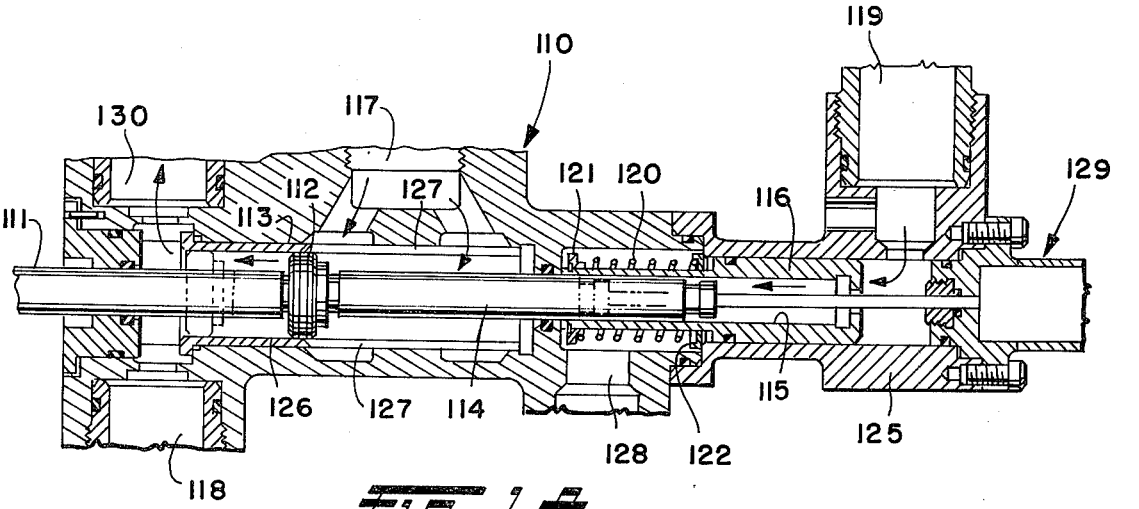

FIGS. 13 through 18 are fragmentary longitudinal section views through another form of free piston engine pump in accordance with this invention, FIGS. 13 through 15 showing the three stages of operation of the pump during the power stroke, and FIGS. 16 through 18 showing the various pump stages during the return stroke.

DESCRIPTION OF THE PREFERRED EMBODIMENTS

Figure 1:
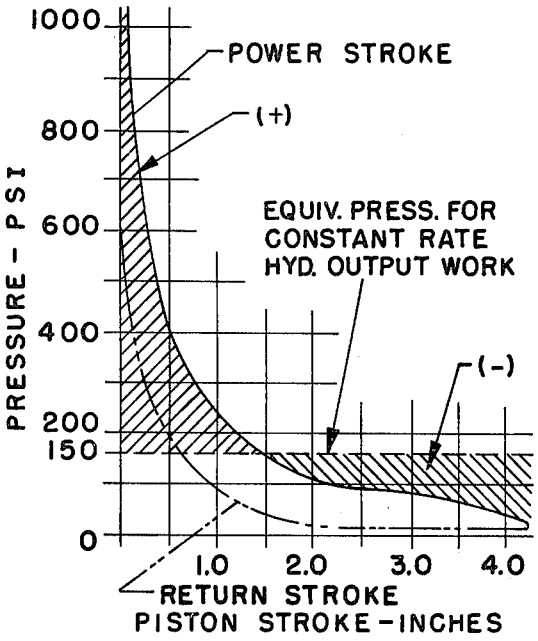
FIGS. 1 and 2 are schematic diagrams of a typical expansion cycle of the power stroke work rate of the internal combustion cycle, FIG. 1 graphically illustrating how a single hydraulic output work rate can be obtained therefrom, and FIG. 2 illustrating the manner of obtaining plural hydraulic output work rates therefrom.
Figure 2:
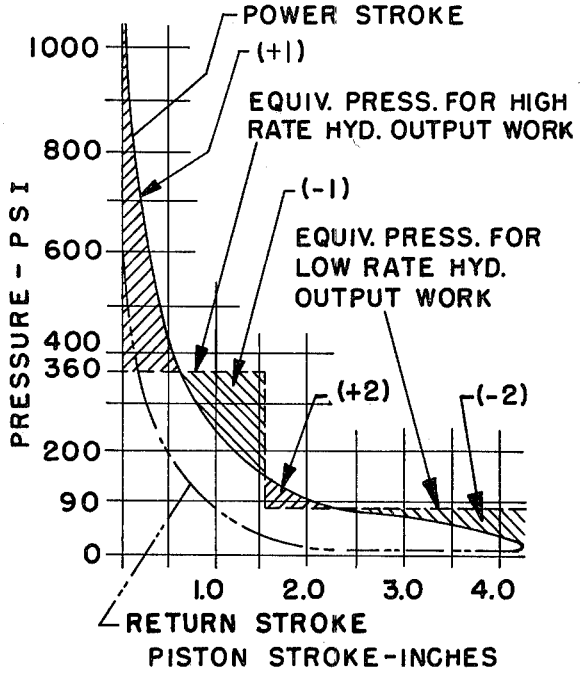

In FIGS. 1 and 2 there is schematically illustrated a typical expansion cycle of the power stroke work rate of the internal combustion cycle. As shown, the maximum pressure output occurs during the first portion of the power stroke when the engine piston is accelerating, and such pressure output drops very rapidly as the engine piston decelerates during the latter portion of the power stroke. For example, the maximum pressure might be 1,000 psi, and the minimum pressure 30 psi, with an average pressure, which is the equivalent pressure for constant rate hydraulic output work, of 150 psi.

To provide a single hydraulic work output rate per the FIG. 1 diagram, the excess energy (+) which must be stored as inertia to supply the required energy (−) later in the stroke is much larger than the excess energies (+1) and (+2) which must be stored as inertia to supply plural levels of the required energies (−1) and (−2) at later phases of the stroke, as per the FIG. 2 diagram. Such plural levels of hydraulic output work (energy) may be achieved in accordance with the present invention by utilizing two or more hydraulic piston areas or hydraulic pressures, with suitable valving to properly "phase" these areas or pressures during the piston stroke, to better match the natural variation of energy (work) rate of the internal combustion cycle, and minimize the inertia-storage of energy required, as more fully described hereafter. Reducing the inertia mass and/or peak velocities for a given power output permits the engine/pump size and weight to be reduced, and also significantly reduces the hydraulic losses and engine/pump mass balancing problems.

Figure 3:
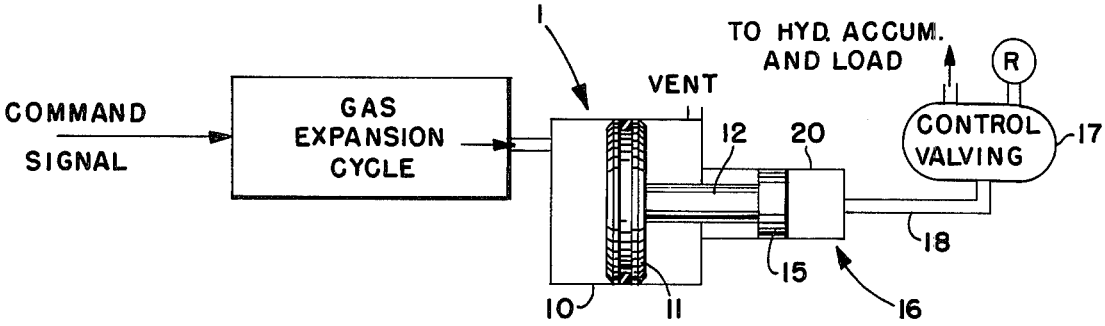
FIG. 3 is a schematic illustration of a free piston engine pump with constant energy output rate.

FIG. 3 schematically illustrates a conventional free piston engine pump 1 including an engine cylinder 10 and piston 11 having an output shaft 12 directly linearly connected to the piston 15 of a hydraulic pump 16, from which fluid is pumped through a single flow path 18. Suitable control valving 17 is shown for directing hydraulic fluid from a high pressure accumulator into the pump cylinder 20 at the end of the power stroke of the engine piston to effect return movement of the engine piston, and with proper timing, connecting the pump cylinder to the reservoir R to replenish the pump cylinder with hydraulic fluid prior to the next power stroke. Both the rod end of the engine cylinder and the non-pressure side of the pump piston may be vented as shown to prevent any undesirable buildup of pressure therein and also prevent cavitation.

If, as schematically indicated in FIG. 3, a high pressure gas is expanded at the head end of the engine cylinder 10 on command for use as the motive force for driving the engine piston 11 during the expansion cycle, the single hydraulic piston 15 area will provide a constant output energy rate as graphically illustrated in FIG. 1 if the discharge pressure is maintained constant as by an accumulator via the control valving 17 and fluid line 18.

Figure 4:
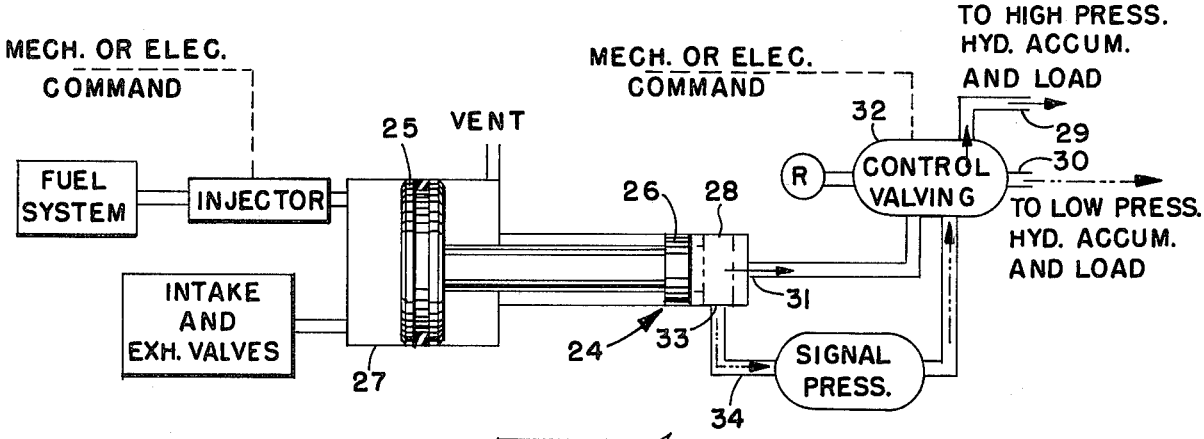
FIG. 4 is a schematic illustration of one form of free piston engine pump in accordance with this invention including a single pump piston area to generate plural hydraulic pressures, and valving to properly phase such pressures during the engine stroke.

The energy rate of an internal combustion engine, or an expansion cycle, as noted previously, is very uneven as a function of stroke and time. Nevertheless the inertia-storage of energy required can be minimized in accordance with the present invention as by utilizing a single hydraulic piston area to generate plural hydraulic pressures during the power stroke of an internal combustion engine, with suitable valving to properly "phase" these pressures during the engine stroke, as graphically shown in FIG. 2. One form of such a pump and valving arrangement 24 in accordance with this invention is depicted in FIG. 4, wherein the engine piston 25 is shown directly linearly connected to the pump piston 26 as in FIG. 3. The combustion chamber 27 may be equipped in the usual manner either with spark plugs or injection nozzles, and provided with the usual intake and exhaust valves.

However, instead of the usual single flow path from the pump cylinder 28, two or more separate flow paths 29 and 30 are provided, each selectively connectable to the discharge port 31 of the pump cylinder through suitable control valving 32. Actuation of the control valving 32 may be controlled as by providing a signal port 33 appropriately located along the axial length of the pump cylinder 28 for conveying a signal pressure to the control valving. The location of the signal port 33 along the length of the pump cylinder 28 will determine the high pressure/low pressure phasing of the pump pressures during the engine stroke.

During the initial portion of the stroke, when the pump pressure is relatively high, the signal pressure in the signal pressure line 34 may be utilized to provide a mechanical or electrical command signal to cause the control valving 32 to direct the pump discharge to the flow path 29 leading to a high pressure hydraulic accumulator and load. When the pump piston 26 reaches the signal port 33 location, shown in phantom lines in FIG. 4, a change in the signal pressure will result, causing the control valving 32 to redirect the pump discharge to the other flow path 30 leading to a low pressure hydraulic accumulator and load during the remaining portion of the power stroke when the pump pressure is much lower. While two such pressure hydraulic "phases" are thus utilized in the FIG. 4 embodiment, it will be apparent that more than two hydraulic phases may be provided by providing the necessary valving and flow paths for each hydraulic pressure phase. The control valving 32 may also selectively be used to direct pressurized hydraulic fluid from one or the other of the hydraulic accumulators to the pump cylinder 28 to effect return movement of the engine piston during the compression stroke and with proper timing replenish the pump cylinder with fluid from the reservoir R prior to the next power stroke.

Alternatively, the fluid in the reservoir R may be maintained under sufficient pressure to effect return movement of the engine piston as well as replenish the pump cylinder with fluid. Moreover, where more than one pressure level is being generated during the power stroke as in the FIG. 4 embodiment, if desired the low pressure fluid accumulator may be used both as the power source to effect return movement of the piston and to replenish the pump cylinder with fluid.

Figure 5:
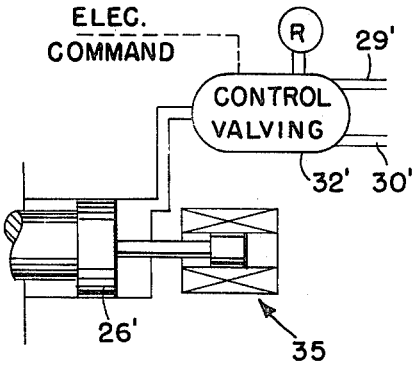
FIG. 5 is a schematic illustration of an electrical piston position sensor responsive to the position of the pump piston for controlling operation of a fluid control valve.

It will also of course be understood that instead of using a single pressure line and signal port location to determine the high pressure/low pressure phasing during the engine piston stroke as in the FIG. 4 embodiment, an electrical piston position sensor 35 may be provided on the end of the pump piston 26' as schematically shown in FIG. 5 to supply an electrical command signal to the control valve 32' for redirecting the pump discharge from the high pressure flow path 29' to the low pressure flow path 30' when the engine piston reaches a particular point during the power stroke.

Figure 6:
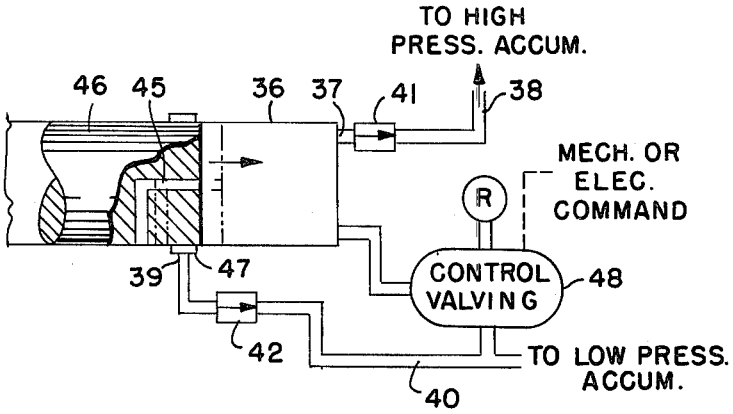
FIGS. 6 and 7 are schematic illustrations showing another form of valving arrangement for use with a single pump piston area to phase plural hydraulic pressures during the power stroke.
Figure 7:
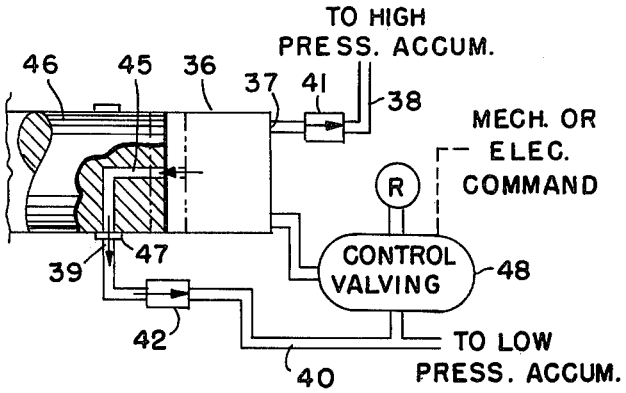

Also, by providing suitable porting in the hydraulic pump, the control valving for selectively directing the pump discharge to the high and low pressure flow paths may be eliminated altogether. One such form of valve arrangement is shown in FIGS. 6 and 7, wherein the pump cylinder 36 is provided with two separate discharge ports, one port 37 being at the outermost end of the pump cylinder communicating with the high pressure accumulator line 38, and the other port 39 being intermediate the length of the pump cylinder communicating with the low pressure accumulator line 40. Each flow path 38, 40 contains a check valve 41, 42 to prevent return flow from the accumulators to the pump. Communication between the low pressure discharge port 39 and the pump cylinder 36 does not occur until after the initial portion of the power stroke, when an internal passage 45 in the pump piston 46 is brought into alignment with an annular groove 47 in the cylinder wall communicating with the port 39.

During the initial high pressure hydraulic phase portion of the power stroke, as the pump piston 46 moves from the solid line position of FIG. 6 to the phantom line position, the low pressure discharge port 39 is blocked by the forward end of the pump piston so that all of the hydraulic fluid that is discharged during such high pressure hydraulic phase flows through the high pressure discharge port 37. Continued movement of the pump piston between the two phantom line positions shown in FIG. 7, during the low pressure hydraulic phase portion of the power stroke, causes the low pressure hydraulic fluid to be discharged through the low pressure discharge port 39. Such low pressure hydraulic fluid will not flow through the high pressure discharge port 37 because of the pressure difference across the check valve 41.

Separate control valving 48 operative either on a mechanical or electrical command may be provided for supplying fluid pressure to the pump cylinder 36 from the low pressure accumulator to effect return movement of the piston and then with proper timing replenish the pump cylinder with hydraulic fluid from the reservoir R prior to the next power stroke.

Figure 8:
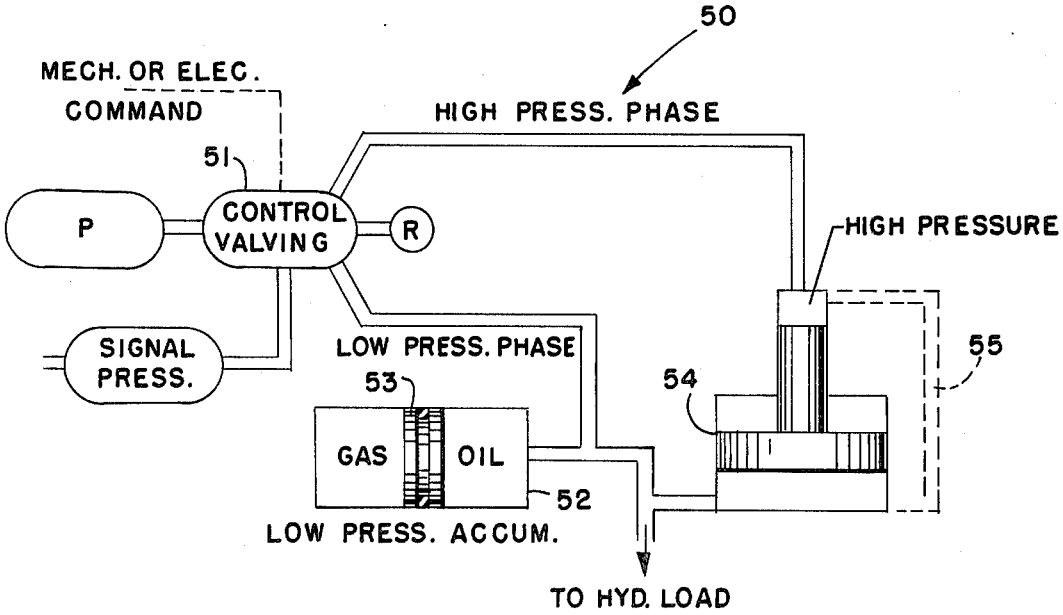
FIG. 8 is a schematic illustration of a dual pressure system for utilizing both the high and lower pressure phases of a free piston engine pump.

A typical dual pressure system 50 for effectively utilizing both the high pressure and low pressure phases generated by such a free piston engine pump P is illustrated in FIG. 8. As shown, the low pressure phase is directed through suitable control valving 51 to a low pressure accumulator 52 containing a piston 53 to separate the hydraulic fluid from the gas contained therein. The accumulator stores the hydraulic fluid at a desired pressure for use in driving a hydraulic load either continuously or intermittently as required.

The high pressure fluid phase may also be directed by the same or separate control valving to a ratio piston storage cylinder 54 in order to reduce the pressure to correspond to the pressure in the low pressure accumulator 52 for use in driving the same or other hydraulic loads as desired. The ratio piston storage cylinder may be provided with an optional ratio piston recycle loop 55 as shown.

Figure 9:
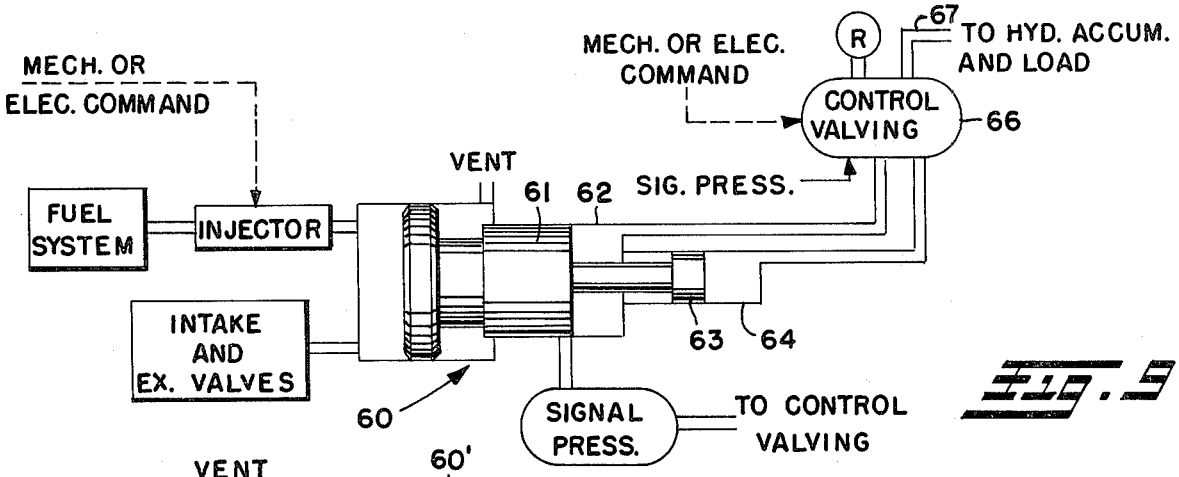
FIG. 9 is a schematic illustration of another form of free piston engine pump in accordance with this invention including plural pump piston areas, together with suitable valving, to obtain a plural output energy rate at substantially constant pressure.

In FIG. 9 there is schematically shown a modified form of free piston engine pump 60 which is similar to the pump 24 shown in FIG. 4, except that instead of utilizing plural hydraulic pressures to generate a plural energy output rate, plural hydraulic piston areas are provided, together with suitable valving to properly "phase" these areas during the engine stroke, so as to obtain a plural output energy rate at substantially constant pressure to minimize the inertia-storage of energy required. The advantage in using plural hydraulic piston areas over plural hydraulic pressures is that while the output energy rate will vary, the pressure of the hydraulic fluid from the pump will remain substantially constant.

In FIG. 9 two separate hydraulic pump piston and cylinder areas are schematically illustrated, the larger hydraulic pump piston 61 and cylinder 62 area being effective to create a relatively high output energy rate at a substantially constant pressure during the initial portion of the power stroke, and the smaller hydraulic pump piston 63 and cylinder 64 area being effective to create a substantially lower output energy rate, but at substantially the same constant pressure, during the latter portion of the power stroke. Control valving 66 responsive either to signal pressure or to a mechanical or electrical command is used to properly phase these piston areas during the engine stroke.

During the initial portion of the power stroke, the output energy rate from both the larger hydraulic pump piston 61 and cylinder 62 area and smaller hydraulic pump piston 63 and cylinder 64 area may be combined for discharge through the flow line 67 to a hydraulic accumulator/load. During the latter portion of the power stroke when the output energy rate is lower, the output energy rate from the smaller hydraulic pump piston 63 and cylinder 64 area is continued to be directed to the hydraulic accumulator/load at substantially constant pressure, whereas the output energy rate from the larger hydraulic pump piston and cylinder area may be minimized, as described hereafter. Fluid pressure for effecting return movement of the piston may be supplied to the pump from the hydraulic accumulator and the pump fluid replenished from the reservoir R as determined by the control valving 66, in the manner previously described.

Figure 10:
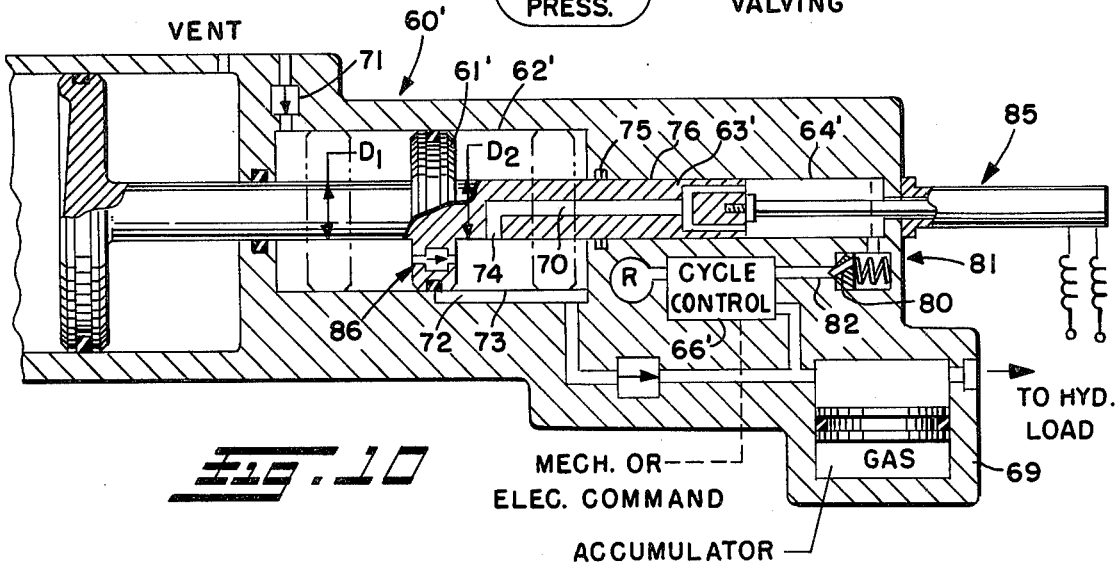
FIG. 10 is a fragmentary longitudinal section view through a preferred form of free piston engine pump incorporating the dual hydraulic pump piston areas of FIG. 9.

The details of one form of free piston engine pump 60' incorporating the dual hydraulic piston areas of FIG. 9 is shown in FIG. 10, and like reference numerals followed by a prime symbol are used to designate like parts. During the first portion of the movement of the larger area pump piston 61' from the leftmost phantom line position to the solid line position, the relatively high output energy rate of the pump is directed to the accumulator 69 at a relatively constant pressure where it is stored for use in driving a hydraulic load as required. At the same time, the pressurized fluid created by the smaller pump piston 63' area is directed to the larger area pump cylinder 62' through an internal passage 70 in the smaller area pump piston for discharge from the pump with the hydraulic fluid from the larger area pump cylinder. Low pressure fluid is supplied to the back side of the large area pump piston through a check valve 71 to prevent cavitation during the first portion of the power stroke.

During the latter portion of the power stroke, when the output energy rate of the pump is reduced, as the larger area pump piston moves from the solid line position to the rightmost phantom line position, the hydraulic fluid within the large area pump cylinder 62' is simply displaced to the other side of the larger area piston 61' through an internal groove 72 in the forward portion of the larger area pump cylinder wall 73, whereas the higher pressure created by the smaller pump area piston 63' is continued to be directed back through the internal passage 70 to the larger area pump cylinder 62' for discharge to the accumulator.

At the end of the power stroke, as the innermost end 74 of the internal passage 70 moves past the seal 75 in the smaller area pump cylinder wall 76, fluid becomes trapped in the smaller area pump cylinder 64' to cushion such end movement. Such trapped fluid is bled off at a controlled rate through a bleed passage 80 in a check valve 81 contained in a fluid line 82 leading from the smaller area pump cylinder 64' to the reservoir R when the cycle control valve 66' is in position establishing communication therebetween.

To initiate the return stroke, an electrical piston position sensor 85 is operative to actuate the cycle control valve 66' to supply hydraulic fluid under pressure to the outermost end of the smaller pump cylinder 64' through the check valve 81 to cause retraction of the piston and replenish the pump fluid, as previously described. A check valve 86 in the large area piston 61' prevents pressure buildup and cavitation on opposite sides of the piston during such return movement. Hydraulic pressure hold down at the end of the power stroke will result if the rod diameter $D_1$ is smaller than the piston diameter $D_2$ and the cycle control valve 66' is switched to return R.

Figure 11:
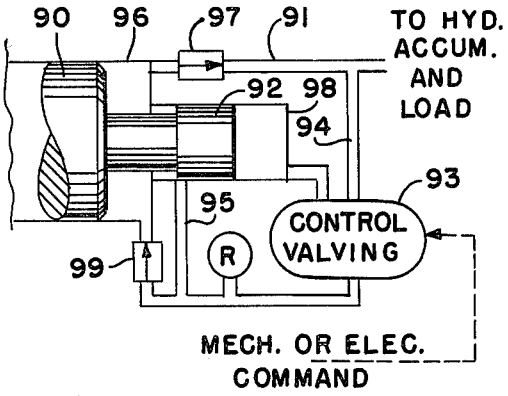
FIG. 11 is a schematic illustration of another valving arrangement for use with a dual area free piston engine pump.

FIG. 11 illustrates another valving arrangement for use with a dual area free piston engine pump of the type previously described. During the high work rate phase of the engine stroke, the hydraulic fluid from the large area pump piston 90 is directed to a hydraulic accumulator/load through a fluid line 91. At the same time, the hydraulic fluid from the small area pump piston 92 is also directed to the same hydraulic accumulator/load through suitable control valving 93 and fluid line 94 to provide a combined average high pressure during the high work rate phase of the work cycle. At the end of the high work rate phase, the small area pump piston 92 uncovers a passage 95 providing communication between the large area pump cylinder 96 and a reservoir R, so that the low pressure hydraulic fluid created by the large area pump piston during the remaining low work rate phase of the stroke is dumped to return. The higher pressure hydraulic fluid generated by the small area pump piston 92 during such low work rate phase is continued to be directed to the hydraulic accumulator/load at constant high pressure. A check valve 97 in the flow path 91 from the large area pump cylinder 96 to the hydraulic accumulator prevents flow in the opposite direction during the low work rate phase of the work cycle.

Return movement is controlled by the control valving 93 which on mechanical or electrical command directs hydraulic fluid under pressure from the accumulator to the small area pump cylinder 98, and then with proper timing connects the small area pump cylinder 28 to the reservoir R. Communication between the reservoir R and the large area pump cylinder 96 is also established during the return stroke through a check valve 99.

Figure 12:
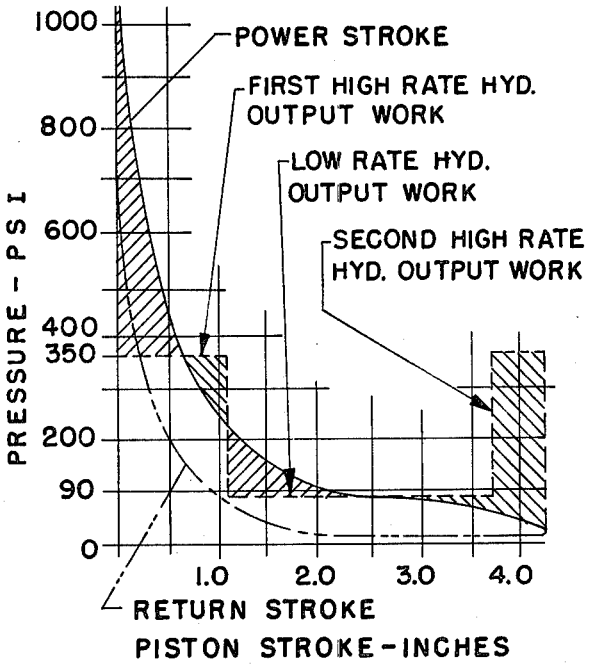
FIG. 12 is a schematic diagram of a typical expansion cycle of an internal combustion engine, with graphic illustration showing relatively high hydraulic output work rates both at the beginning and end of the power stroke and a lesser hydraulic output work rate intermediate the ends of the stroke.

In FIGS. 13 through 18 there is shown yet another free piston engine pump 110 embodiment in accordance with the present invention including plural hydraulic piston areas with suitable valving to properly "phase" these piston areas during the engine stroke, similar to the pump embodiments of FIGS. 9 through 11. However, rather than having just two pump stages as in the previous embodiments, the pump 110 has three stages, graphically illustrated in FIG. 12. The first stage is a high work rate phase which occurs at the beginning of the power stroke, followed by a second stage low rate phase intermediate the ends of the power stroke. The third stage occurs at the end of the power stroke in which there is a second high work rate phase which causes rapid deceleration at the end of the stroke to effect a higher ratio of average piston speed to peak speed and tends to reduce cycle time without incurring the efficiency losses which accompany higher piston speeds.

The pump 110 includes a rod extension 111, adapted to be directly linearly connected to the output shaft of an internal combustion engine, to drive both a large area pump piston 112 in its cylinder 113, and a small area pump piston 114 in its cylinder 115. The cylinder 115 may comprise an axially movable sleeve providing yet another large area pump piston 116. A spring 120 interposed between a pair of retainer rings 121, 122 maintains the piston 116 in its retracted position shown in FIG. 13 during shutdown to insure that the parts are in proper assembled relation with the piston 114 received in the inner end of the cylinder 115 at the time of startup. The ring 121 engages a snap ring 123 on the inner end of the sleeve, whereas the ring 122 engages an internal shoulder 124 on the pump housing 125.

During the first stage high work rate phase of the power stroke shown in FIG. 13, the large area pump piston 112 moves within its own cylinder 113 between the solid and phantom line positions to generate a high output energy rate at a substantially constant pressure in the fluid line 117. During such movement, low pressure fluid is admitted to the back side of the large area pump piston 112 through a fluid line 118 to prevent cavitation. The fluid line 118 contains a check valve, not shown, to prevent fluid flow therethrough in the reverse direction. At the same time, the small area pump piston 114 moves within the cylinder 115 between its solid and phantom line positions to create additional high pressure fluid which is directed through the fluid line 119 and combined with the high pressure from the large area pump cylinder to establish an average high pressure. The movable piston 116 is held against movement during the first stage by the differential pressure acting thereon.

During the second stage of the power stroke, as shown in FIG. 14, both the large and small area pump pistons continue their axial movement within their respective cylinders while the movable sleeve 116 is still retained in place by the differential pressure acting thereon. However, because of the drop-off of the work rate during the second stage phase of operation, the internal wall 126 of the large area pump cylinder 113 is slotted at 127 to eliminate any pumping action by the large area piston 112 during the second stage movement. The relatively high hydraulic fluid pressure that is generated by the small area pump piston 114 during the second stage movement is continued to be directed to the hydraulic accumulator/load.

During the third stage of the power stroke, shown in FIG. 15, the large area pump piston is still precluded from generating any additional high pressure flow because of the slots 127 in the large area cylinder wall 126. However, at this point the forward end of the small area pump piston 114 engages the end of the movable sleeve 116 so that the small area pump piston 114 and sleeve 116 move as a unit from the solid line position shown in FIG. 15 to the phantom line position to create additional high output energy rate to the system which results in a high decelerating force acting on the pump at the end of the power stroke, thus effecting a higher ratio of average piston speed to peak speed, which tends to reduce cycle time without incurring the efficiency losses which accompany higher piston speeds. Low pressure fluid is supplied to the back side of the movable sleeve 116 through fluid line 128 to prevent cavitation during such third stage movement thereof.

To effect return movement, an electrical piston position sensor 129 is operative to actuate suitable control valving, not shown, to supply high pressure fluid to the pump and with proper timing replenish the pump with fluid as before. The high pressure fluid acting on the end of the movable sleeve 116 and small area pump piston 114, first causes the sleeve and small and large area pump pistons to move from the solid to the phantom line positions shown in FIG. 16, returning the movable sleeve to its initial position; then causes the small area pump piston 114 to move relative to the sleeve 116 and the large area pump piston 112 to move from the solid line position to the phantom line position shown in FIG. 17; and finally causes the small and large area pump pistons 114, 112 to move from the solid to the phantom line positions shown in FIG. 18. Because of the different piston areas acted on by the high pressure fluid during the return stroke, the return stroke energy is applied to the pump at a non-uniform rate to achieve optimum return stroke timing and accelerated return movement of the pump. The piston momentum carries the piston through the latter portion of the return stroke while fluid is supplied to the pump from a reservoir, not shown, to replenish the pump with fluid prior to the next power stroke. During the latter movement of the large area pump piston 112, the high pressure hydraulic fluid behind the pump piston is forced out of the large area pump cylinder 113 through a fluid line 130 containing a check valve, not shown. High pressure fluid is returned to pump cylinder 113 through a fluid line 117 to maintain a pressure balance across large piston 112.

While it is preferred that the hydraulic pressures created by the various pump stages of the FIGS. 9 through 18 pump embodiments be the same, it will be apparent that each stage may be used to generate a different pressure, or two or more of the pump stages may be operated at the same pressure, and other stages operated at different pressures, if desired. For example, the first stage of pump 120 could be operated at one pressure and the second and third stages operated at a different pressure. However, in that event the different pressures should be connected to separate accumulators.

From the foregoing, it will now be apparent that the various forms of free piston engine pumps in accordance with the present invention effectively smooth out the energy or work rate of a free piston engine by utilizing plural hydraulic piston areas or hydraulic pressures, with suitable valving to properly "phase" these areas or pressures during the engine stroke, to minimize the inertia-storage of energy required.

The embodiments of the invention in which an exclusive property or privilege is claimed are defined as follows:

1. A free piston engine pump comprising hydraulic pump means including plural piston and cylinder areas of different effective areas adapted to be simultaneously linearly driven by such engine to generate different hydraulic work rates during the engine power stroke, means for phasing such different hydraulic work rates at different points during the power stroke to provide plural levels of hydraulic output work in order to smooth out the hydraulic energy or work rate of said free piston engine, and means for supplying hydraulic energy to said plural piston and cylinder areas at different points during the return stroke to achieve optimum return stroke timing to accelerate the return movement of said hydraulic pump means during the return stroke.

2. A free piston engine pump comprising hydraulic pump means including plural piston and cylinder areas of different effective areas adapted to be simultaneously linearly driven by such engine to generate different hydraulic work rates during the engine power stroke, means for phasing such different hydraulic work rates at different points during the power stroke to provide plural levels of hydraulic output work in order to smooth out the hydraulic energy or work rate of said free piston engine, and means for generating a higher hydraulic input work rate during the beginning of the return stroke, and for generating a lower hydraulic input work rate during another portion of the return stroke to achieve optimum return stroke timing during the return stroke.

3. A free piston engine pump comprising hydraulic pump means including plural piston and cylinder areas, one of said plural piston and cylinder areas being larger than another for generating different hydraulic output energy rates during the power stroke, and means for phasing the hydraulic output energy rates of said plural piston and cylinder areas during the power stroke to provide plural levels of hydraulic output work in order to smooth out the hydraulic energy or work rate of said free piston engine, said means for phasing including means for combining the hydraulic output energy rate from more than one of said piston and cylinder areas during the initial portion of such power stroke, and means for minimizing the hydraulic output energy rate of the larger of said piston and cylinder areas during another portion of the power stroke, including a groove in the wall of the larger area cylinder extending over the length of the latter portion of movement of the larger area piston, whereby the larger area piston is ineffective to pressurize hydraulic fluid during such latter portion of movement of the power stroke.

4. A free piston engine pump operative to smooth out the hydraulic energy or work rate of a free piston engine comprising hydraulic pump means including three piston and cylinder areas, one of said piston and cylinder areas being larger than another for generating different hydraulic output energy rates during the power stroke, and valve means for phasing the hydraulic output energy rates of said plural piston and cylinder areas during the power stroke, said valve means being operative to cause two of said piston and cylinder areas to generate a relatively high hydraulic output energy rate at a substantially constant pressure during the initial portion of said power stroke, to cause one of said two piston and cylinder areas to generate a relatively small hydraulic output energy rate at substantially the same constant pressure during an intermediate portion of the power stroke, and to cause said one and the third piston and cylinder areas to generate additional hydraulic output energy rate at substantially the same constant pressure during deceleration of said pistons at the end of the power stroke.

5. A free piston engine pump operative to smooth out the hydraulic energy or work rate of a free piston engine comprising hydraulic pump means including plural piston and cylinder areas for generating different hydraulic output energy rates during the power stroke, and valve means for phasing the hydraulic output energy rates of said plural piston and cylinder areas during the power stroke, said valve means including means for providing at least three hydraulic energy wrok rate phases during the power stroke, a first phase during the initial portion of the power stroke in which a first large area pump piston generates a high output hydraulic energy rate, a second phase during an intermediate portion of the power stroke in which a second smaller area pump piston generates a smaller hydraulic output energy rate, and a third phase during the latter portion of the power stroke in which a third pump piston generates an additional hydraulic output energy rate, said first and second pistons being directly linearly connected together for simultaneous movement, and said second piston being mounted for axial movement relative to said third piston during such first and second phases and engageable with said third piston during the third phase to cause said third piston to move with said second piston during such third phase.

6. The pump of claim 5 further comprising spring means for retaining said third piston in its retracted position during shutdown of said pump to insure proper orientation of said third piston relative to said second piston at the time of pump start-up.

7. A free piston engine pump operative to smooth out the hydraulic energy or work rate of a free piston engine comprising hydraulic pump means including plural piston and cylinder areas of different sizes for generating different hydraulic output energy rates during the power stroke, and valve means for phasing the hydraulic output energy rates of said different size piston and cylinder areas during the power stroke, said valve means including means for providing at least three hydraulic energy work rate phases during the power stroke, a first phase during the initial portion of the power stroke in which a first large area pump piston generates a high output hydraulic energy rate, a second phase during an intermediate portion of the power stroke in which a second smaller area pump piston generates a smaller hydraulic output energy rate, and a third phase during the latter portion of the power stroke in which a third intermediate size pump piston generates an additional hydraulic output energy rate.

8. The pump of claim 7 wherein means are provided for combining the hydraulic output energy rate of both the first and second pump pistons during the first phase.

9. A free piston pump driven by an expansion cycle free piston power cylinder comprising hydraulic pump means including plural piston and cylinder areas, one of said plural piston and cylinder areas being larger than another for generating different output energy rates during the power stroke, and valve means for phasing the hydraulic output energy rates of said plural piston and cylinder areas during the power stroke to smooth out the hydraulic energy or work rate of said expansion cycle free piston power cylinder.

10. The pump of claim 9 wherein said valve means is operative to obtain a relatively high hydraulic output energy rate at a substantially constant pressure from the larger of said piston and cylinder areas during the initial portion of the power stroke, and obtain a lower hydraulic energy output rate at substantially the same constant pressure from the smaller of said piston and cylinder areas during another portion of the power stroke.

11. The pump of claim 9 wherein means are provided for combining the output energy rate from more than one of said piston and cylinder areas during a portion of such power stroke.

12. A free piston engine pump comprising hydraulic pump means adapted to be linearly driven by such engine to generate plural hydraulic work rates during the engine power stroke, and valve means for phasing such plural hydraulic work rates at different points during the power stroke to provide plural levels of hydraulic output work in order to smooth out the hydraulic energy or work rate of said free piston engine, said pump means including plural piston and cylinder areas of different sizes for generating different hydraulic output energy rates at substantially the same pump pressure at different points during the power stroke, said valve means being operative to phase the different hydraulic output energy rates of said different size piston and cylinder areas at such different points during the power stroke to provide a relatively constant hydraulic output pump pressure throughout substantially the entire power stroke.

13. The pump of claim 12 wherein the larger piston and cylinder area produces a relatively constant hydraulic output pump pressure during the intitial portion of the power stroke and the smaller piston and cylinder area produces substantially the same hydraulic output pump pressure during another portion of the power stroke.

14. The pump of claim 12 wherein said plural piston and cylinder areas are in coaxial alignment with each other and said pistons are axially connected together for reciprocating movement as a unit.

15. A free piston engine pump comprising hydraulic pump means including plural piston and cylinder areas of different effective areas adapted to be simultaneously linearly driven by such engine to generate different hydraulic work rates during the engine power stroke, and means for phasing such different hydraulic work rates at different points during the power stroke to provide plural levels of hydraulic output work in order to smooth out the hydraulic energy or work rate of said free piston engine, said means for phasing including means for combining the hydraulic output work rates of at least two piston and cylinder areas of different effective areas during the initial portion of the power stroke, and means for minimizing the hydraulic output work of the larger of said piston and cylinder areas during another portion of such power stroke, said means for minimizing comprising cooperating surfaces on one of said piston and cylinder areas for preventing said larger piston and cylinder area from generating hydraulic pressure during such another portion of such power stroke.

16. The pump of claim 15 wherein said cooperating surfaces includes slots in the wall of said larger piston cylinder for preventing said larger piston from generating additional hydraulic pressure during such another portion of such power stroke.

17. The pump of claim 15 wherein said cooperating surfaces includes a vent in one of said cylinder areas which is uncovered by one of said piston areas to vent said larger cylinder area during such another portion of such power stroke.

18. A free piston engine pump operative to smooth out the hydraulic energy or work rate of a free piston engine comprising hydraulic pump means including plural piston and cylinder areas for generating different hydraulic output energy rates during the power stroke, and valve means for phasing the hydraulic output energy rates of said plural piston and cylinder areas during the power stroke, said valve means including means for providing at least three hydraulic energy work rate phases during the power stroke, a first phase during the initial portion of the power stroke in which a first large area pump piston generates a high output hydraulic energy rate, a second phase during an intermediate portion of the power stroke in which a second smaller area pump piston generates a smaller hydraulic output energy rate, and a third phase during the latter portion of the power stroke in which a third pump piston generates an additional hydraulic output energy rate, said pump further including means for combining the hydraulic output energy rate of both the first and second pump pistons during the first phase, and means for combining the hydraulic output energy rate of the second and third pistons during the third phase.

19. The pump of claim 18 wherein means are provided to permit only said second piston to generate a hydraulic output energy rate during the second phase.

20. The pump of claim 18 wherein means are provided for minimizing the hydraulic output energy rate of said first piston during the second and third phases of such power stroke.

21. The pump of claim 20 wherein said last-mentioned means comprises slots in the wall of said first piston cylinder for preventing said first piston from generating additional hydraulic pressure during the second and third phases of such power stroke.

22. The pump of claim 18 wherein means are provided for making said third piston ineffective in generating a hydraulic output energy rate during the first and second phases of such power stroke.

23. The pump of claim 22 wherein said last-mentioned means comprises a hydraulic pressure differential acting on said third piston resisting movement thereof, said second piston being axially movable relative to said third piston during the first and second phases of such power stroke, and being engageable with said third piston for causing said third piston to move with said second piston during the third phase to provide a combined hydraulic output energy rate from said second and third pistons during such third phase.

24. A free piston engine pump comprising hydraulic pump means including plural piston and cylinder areas of different effective areas adapted to be simultaneously linearly driven by such engine to generate different hydraulic work rates during the engine power stroke, and means for phasing such different hydraulic work rates at different points during the power stroke to provide plural levels of hydraulic output work in order to smooth out the hydraulic energy or work rate of said free piston engine.

25. The pump of claim 24 wherein said means for phasing includes means for combining the hydraulic output work rates of at least two piston and cylinder areas of different effective areas during the initial portion of the power stroke, and means for minimizing the hydraulic output work of the larger of said piston and cylinder areas during another portion of such power stroke.

26. The pump of claim 25 further comprising means for generating additional hydraulic output work from at least one of said piston and cylinder areas during deceleration and said hydraulic pump means at the end of the power stroke.

27. The pump of claim 26 wherein said plural levels of hydraulic output work that are generated by said plural piston and cylinder areas during the power stroke are at substantially the same constant pressure.

28. The pump of claim 24 wherein means are provided for directing a portion of the hydraulic output work generated during the power stroke back to said hydraulic pump means to effect return movement of said hydraulic pump means during the return stroke.

29. The pump of claim 24 wherein said means for phasing includes valve means for causing such phasing of such hydraulic output energy rates of said plural piston and cylinder areas during the power stroke.

30. The pump of claim 29 wherein said valve means is operative to obtain a relatively high hydraulic energy output rate at a substantially constant pressure from a larger one of said piston and cylinder areas during the initial portion of the power stroke, and obtain a lower hydraulic energy output rate at substantially the same constant pressure from a smaller one of said piston and cylinder areas during such another portion of the power stroke.

31. The pump of claim 30 wherein means are provided for combining the hydraulic energy output rates from more than one of said piston and cylinder areas during such initial portion of such power stroke.

32. The pump of claim 31 wherein means are provided for minimizing the hydraulic energy output rate of the larger of said piston and cylinder areas during such another portion of the power stroke.

* * * * *